US010697255B2

(12) United States Patent
Orr et al.

(10) Patent No.: US 10,697,255 B2
(45) Date of Patent: Jun. 30, 2020

(54) TUBULAR DELIVERY ARM FOR A DRILLING RIG

(71) Applicant: Schlumberger Technology Corporation, Sugar Land, TX (US)

(72) Inventors: Melvin Alan Orr, Tulsa, OK (US); Mark W. Trevithick, Cypress, TX (US); Joe Rodney Berry, Cypress, TX (US); Robert Metz, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 268 days.

(21) Appl. No.: 15/311,857

(22) PCT Filed: Nov. 15, 2016

(86) PCT No.: PCT/US2016/061956
§ 371 (c)(1),
(2) Date: Nov. 17, 2016

(87) PCT Pub. No.: WO2017/087350
PCT Pub. Date: May 26, 2017

(65) Prior Publication Data

US 2018/0087331 A1 Mar. 29, 2018

Related U.S. Application Data

(60) Provisional application No. 62/330,012, filed on Apr. 29, 2016, provisional application No. 62/255,997, filed on Nov. 16, 2015.

(51) Int. Cl.
*E21B 19/20* (2006.01)
*E21B 19/06* (2006.01)
(Continued)

(52) U.S. Cl.
CPC ..... *E21B 19/06* (2013.01); *E21B 19/14* (2013.01); *E21B 19/155* (2013.01)

(58) Field of Classification Search
CPC ..... E21B 19/14; E21B 19/155; E21B 19/06
See application file for complete search history.

(56) References Cited

U.S. PATENT DOCUMENTS 2,412,020 A 12/1946 Walters
3,253,995 A * 5/1966 Antonsen ..... G21C 19/02 376/271
(Continued)

FOREIGN PATENT DOCUMENTS

DE 102012016878 A1 * 2/2014 ..... E21B 19/15
EP 0979924 B1 4/2003
(Continued)

*Primary Examiner* — Gregory W Adams
(74) *Attorney, Agent, or Firm* — Rachel E. Greene

(57) ABSTRACT

A tubular delivery arm that travels vertically along a rail on the front of a drilling mast in generally parallel orientation to the travel of a top drive. The tubular delivery arm has a dolly vertically translatably connected to a mast of the drilling rig. An arm is rotatably and pivotally connected to the dolly at its upper end. A tubular clasp is pivotally connected to the arm at its lower end. The dolly vertically translates the front side of the mast in response to actuation of a hoist at the crown of the mast. The tubular delivery arm translates the mast in non-conflicting passage of a top drive connected to the same mast, for positioning a tubular stand over the centerline of the wellbore, a mousehole, or a stand hand-off position.

16 Claims, 18 Drawing Sheets

(51) Int. Cl.
*E21B 19/14* (2006.01)
*E21B 19/15* (2006.01)

(56) References Cited

U.S. PATENT DOCUMENTS 3,874,518 A 4/1975 Swoboda, Jr. et al.
4,042,123 A 8/1977 Sheldon et al.
4,274,778 A 6/1981 Putnam et al.
4,348,920 A 9/1982 Boyadjieff
4,421,179 A 12/1983 Boyadjieff
4,462,733 A 7/1984 Langowski et al.
4,501,522 A * 2/1985 Causer ..... B25J 3/04 414/4
4,610,315 A 9/1986 Koga et al.
4,621,974 A 11/1986 Krueger
4,715,761 A 12/1987 Berry et al.
4,738,321 A 4/1988 Olivier
4,850,439 A 7/1989 Lund
5,038,871 A 8/1991 Dinsdale
5,107,940 A 4/1992 Berry
5,211,251 A 5/1993 Woolslayer
5,423,390 A * 6/1995 Donnally ..... E21B 19/14 166/77.52
6,220,807 B1 4/2001 Sorokan
6,513,605 B1 2/2003 Lodden
6,557,651 B1 5/2003 Norby et al.
6,591,471 B1 7/2003 Hollingsworth et al.
6,591,904 B2 7/2003 Cicognani
6,609,565 B1 * 8/2003 Andreychuk ..... E21B 15/00 166/77.2
6,748,823 B2 6/2004 Pietras
6,779,614 B2 * 8/2004 Oser ..... E21B 19/15 166/85.1
6,821,071 B2 11/2004 Woolslayer et al.
6,860,337 B1 3/2005 Orr et al.
6,976,540 B2 12/2005 Berry
6,997,265 B2 2/2006 Berry
7,043,814 B2 5/2006 Hollingsworth et al.
7,114,235 B2 10/2006 Jansch et al.
7,140,445 B2 11/2006 Shahin et al.
7,219,744 B2 5/2007 Pietras
7,246,983 B2 7/2007 Zahn et al.
7,331,746 B2 2/2008 Wright et al.
7,353,880 B2 4/2008 Pietras
7,451,826 B2 11/2008 Pietras
7,677,856 B2 3/2010 Standal
7,681,632 B2 * 3/2010 Wood ..... E21B 7/02 166/77.1
7,699,122 B2 4/2010 Eriksen
7,794,192 B2 * 9/2010 Wright ..... E21B 19/14 414/22.65
7,802,636 B2 9/2010 Childers et al.
7,828,085 B2 11/2010 Kuttel et al.
7,931,077 B2 4/2011 Rudshaug et al.
8,028,748 B2 10/2011 Laitolais, Jr. et al.
8,052,370 B2 * 11/2011 Dekker ..... E21B 19/146 414/22.66
8,186,455 B2 5/2012 Childers et al.
8,186,925 B2 * 5/2012 Littlely ..... E21B 19/155 414/22.55
8,186,926 B2 * 5/2012 Littlely ..... E21B 19/155 414/22.55
8,215,887 B2 7/2012 Fikowski et al.
8,317,448 B2 11/2012 Hankins et al.
8,397,837 B2 * 3/2013 Skogerbo ..... E21B 19/155 166/250.01
8,550,761 B2 10/2013 Belik et al.
8,584,773 B2 11/2013 Childers et al.
8,839,881 B1 9/2014 Baumler
8,839,884 B2 9/2014 Kuttel et al.
8,910,719 B2 * 12/2014 Kockeis ..... E21B 19/155 166/380
8,949,416 B1 2/2015 Barnes et al.
8,961,093 B2 2/2015 Springett et al.
8,992,152 B2 * 3/2015 Nouwens ..... E21B 19/155 414/22.55
9,010,410 B2 4/2015 Story
9,562,407 B2 2/2017 Magnuson
9,624,739 B2 4/2017 Kannegaard et al.
10,053,934 B2 8/2018 Keogh et al.
2004/0069532 A1 4/2004 Keast
2005/0173154 A1 8/2005 Lesko
2007/0193750 A1 8/2007 Wright et al.
2008/0164064 A1 7/2008 Belik et al.
2008/0302525 A1 12/2008 Beierbach et al.
2009/0053015 A1 2/2009 Zachariasen et al.
2009/0274545 A1 11/2009 Liess et al.
2010/0243325 A1 9/2010 Veeningen
2010/0303586 A1 12/2010 Hankins et al.
2010/0326672 A1 12/2010 Childers et al.
2011/0079434 A1 4/2011 Belik et al.
2011/0174483 A1 7/2011 Odell et al.
2012/0020758 A1 1/2012 Springett et al.
2012/0067642 A1 3/2012 Magnuson
2012/0305261 A1 * 12/2012 Roodenburg ..... E21B 15/02 166/352
2013/0025937 A1 1/2013 Pilgrim et al.
2013/0112395 A1 5/2013 Story
2013/0220601 A1 8/2013 Ferrari
2013/0284450 A1 * 10/2013 Roodenburg ..... E21B 15/02 166/352
2014/0110174 A1 * 4/2014 Childers ..... E21B 19/20 175/52
2014/0124218 A1 5/2014 Pilgrim
2014/0202769 A1 7/2014 Magnuson
2014/0328650 A1 11/2014 Hu
2016/0060979 A1 3/2016 Magnuson
2017/0234088 A1 8/2017 Orr et al.
2018/0328112 A1 11/2018 Berry et al.
2019/0017334 A1 1/2019 Loeyning et al.
2019/0106950 A1 4/2019 Alvaer et al.

FOREIGN PATENT DOCUMENTS

RU 2100565 C1 12/1997
RU 2541972 C2 2/2015
WO WO-9315303 A1 * 8/1993 ..... E21B 19/155
WO 0111181 A1 2/2001
WO WO-0218742 A1 * 3/2002 ..... E21B 15/00
WO WO-2006059910 A1 * 6/2006 ..... E21B 19/146
WO 2010141231 A2 12/2010
WO WO-2011016719 A1 * 2/2011 ..... E21B 19/155
WO 2011056711 A2 5/2011
WO WO-2012148286 A1 * 11/2012 ..... E21B 19/087
WO WO-2014029812 A2 * 2/2014 ..... E21B 19/15
WO 2016204608 A1 12/2016
WO 2017087200 A1 5/2017
WO 2017087349 A1 5/2017
WO 2017087350 A1 5/2017

* cited by examiner

TUBULAR DELIVERY ARM FOR A DRILLING RIG

CROSS REFERENCE TO RELATED APPLICATIONS

This application is a National Stage application of International Application No. PCT/US2016/061956 filed Nov. 15, 2016, which claims priority to U.S. Provisional Application Ser. No. 62/255,997, filed Nov. 19, 2015, and to U.S. Provisional Application Ser. No. 62/330,912, filed Apr. 29, 2016. These three applications are incorporated herein by reference in their entirety.

BACKGROUND

In the exploration of oil, gas and geothermal energy, drilling operations are used to create boreholes, or wells, in the earth. Modern drilling rigs may have two, three, or even four mast sections for sequential connection and raising above a substructure. The drilling rigs are transported to the locations where drilling activity is to be commenced. Once transported, large rig components are moved from a transport trailer into engagement with the other components located on the drilling pad.

Moving a full-size drilling rig requires significant disassembly and reassembly of the substructure, mast, and related component. Speed of disassembly and reassembly impacts profitability but safety is the primary concern. A reduction in disassembly reduces errors and delay in reassembly.

Transportation constraints and cost limit many of the design opportunities for building drilling rigs that can drill a well faster. Conventional drilling involves having a drill bit on the bottom of the well. A bottom-hole assembly is located immediately above the drill bit where directional sensors and communications equipment, batteries, mud motors, and stabilizing equipment are provided to help guide the drill bit to the desired subterranean target.

A set of drill collars are located above the bottom-hole assembly to provide a non-collapsible source of weight to help the drill bit crush the formation. Heavy weight drill pipe is located above the drill collars for safety. The remainder of the drill string is mostly drill pipe, designed to be under tension. Each drill pipe is roughly 30 feet long, but lengths vary based on the style. It is common to store lengths of drill pipe in "doubles" (two connected lengths) or "triples" (three connected lengths) or even "fourables" (four connected lengths). A "tubular stand" refers to connected sections of drill pipe, drill collars, or casing.

When the drill bit wears out, or when service, repairs or adjustments need to be made to the bottom-hole assembly, the drill string (drill pipe and other components) is removed from the wellbore and setback. When removing the entire drill string from the well, it is typically disconnected and setback in doubles or triples until the drill bit is retrieved and exchanged. This process of pulling everything out of the hole and running it all back in the hole is known as "tripping."

Tripping is non-drilling time and, therefore, an expense. Efforts have long been made to devise ways to avoid it or at least speed it up. Running triples is faster than running doubles because it reduces the number of threaded connections to be disconnected and then reconnected. Triples are longer and therefore more difficult to handle due to their length and weight and the natural waveforms that occur when moving them around. Manually handling moving pipe in the derrick and at the drill floor level can be dangerous.

It is desirable to have a drilling rig with the capability to increase safety and reduce trip time. It is desirable to have a drilling rig with the capability of handing stands of drilling tubulars to devices alternative to conventional elevators and top drives. It is also desirable to have a system that includes redundancy, such that if an element of the system fails or requires servicing, the task performed by that unit can be taken-up by another unit on the drilling rig.

Most attempts to automate pipe handling are found offshore. However, solutions for pipe delivery on offshore drilling rigs are seldom transferable to onshore land rigs, due to the many differences in economic viability, size, weight, and transportation considerations.

SUMMARY

The disclosed subject matter of the application relates to an independent secondary hoisting machine that is adaptable for use on a conventional drilling rig, or on a specialized drilling rig in combination with other equipment designed to take advantage of the auxiliary hoisting capability.

A tubular delivery arm is provided that independently travels vertically along a connection to the drilling mast with lifting capacity limited to that of a stand of tubulars, (connected sections of drill collars, drill pipe, or drill casing). The tubular delivery arm has a tilt capability to move the tubular stands horizontally in the drawworks to V-door direction, reaching positions that include the centerlines for the wellbore, stand hand-off position, mousehole, and the catwalk.

In one embodiment, the tubular delivery arm comprises a dolly vertically translatably connected to a drilling mast. The connection may be sliding as with slide pads or a roller connection or other means. An arm bracket is attached to the dolly. An arm, or pair of arms, is pivotally and rotationally connected to the arm bracket of the dolly. An actuator bracket is connected between the arms, or to the arm. A tilt actuator is pivotally connected between the actuator bracket and the dolly or arm bracket. A clasp is pivotally connected to the lower end of the arm. The tilt actuator permits the clasp to swing over the centerlines of at least the wellbore and a stand hand-off position. The dolly vertically translates the mast in response to actuation of a hoist at the crown of the mast such as by wireline.

In one embodiment, a centerline of a drill pipe secured in the clasp is located between the clasp pivot connections at the lower ends of each arm. In another embodiment, an extendable incline actuator is pivotally connected between each arm and the tubular clasp. Extension of the incline actuators inclines the clasp to permit tilting of heavy tubular stands, such as large collars.

In another embodiment, a rotary actuator is mounted to the arm bracket and having a drive shaft extending through the arm bracket. A drive plate is rotatably connected to the arm bracket and connected to the drive shaft to provide rotation between the dolly and the arm.

In another embodiment, a grease dispenser is attached to the tubular delivery arm proximate to the clasp for dispensing grease into the pin connection of a tubular stand secured by the clasp of the tubular delivery arm. This embodiment permits automatic greasing (conventionally known as "doping") the box connection positioned above the clasp.

The tubular delivery arm provides a mechanism for use in a new drilling rig configuration or for adaptation to a conventional drilling rig system to reduce the time for tripping drilling tubulars.

As will be understood by one of ordinary skill in the art, the assembly disclosed may be modified and the same advantageous result obtained. It will also be understood that as described, the mechanism can be operated in reverse to remove drill stand lengths of a drill string from a wellbore for orderly bridge crane stacking. Although a configuration related to triples is being described herein, a person of ordinary skill in the art will understand that such description is by example only and would apply equally to doubles and fourables.

BRIEF DESCRIPTION OF THE DRAWINGS

The objects and features of the disclosed embodiments will become more readily understood from the following detailed description and appended claims when read in conjunction with the accompanying drawings in which like numerals represent like elements.

The drawings constitute a part of this specification and include exemplary embodiments which may be embodied in various forms. It is to be understood that in some instances various aspects of the disclosed embodiments may be shown exaggerated or enlarged to facilitate an understanding of the principles and features of the disclosed embodiments.

DETAILED DESCRIPTION

The following description is presented to enable any person skilled in the art to make and use the tubular delivery arm, and is provided in the context of a particular application and its requirements. Various modifications to the disclosed embodiments will be readily apparent to those skilled in the art, and the general principles defined herein may be applied to other embodiments and applications without departing from their spirit and scope. Thus, the disclosure is not intended to be limited to the embodiments shown, but is to be accorded the widest scope consistent with the principles and features disclosed herein.

Figure 1:
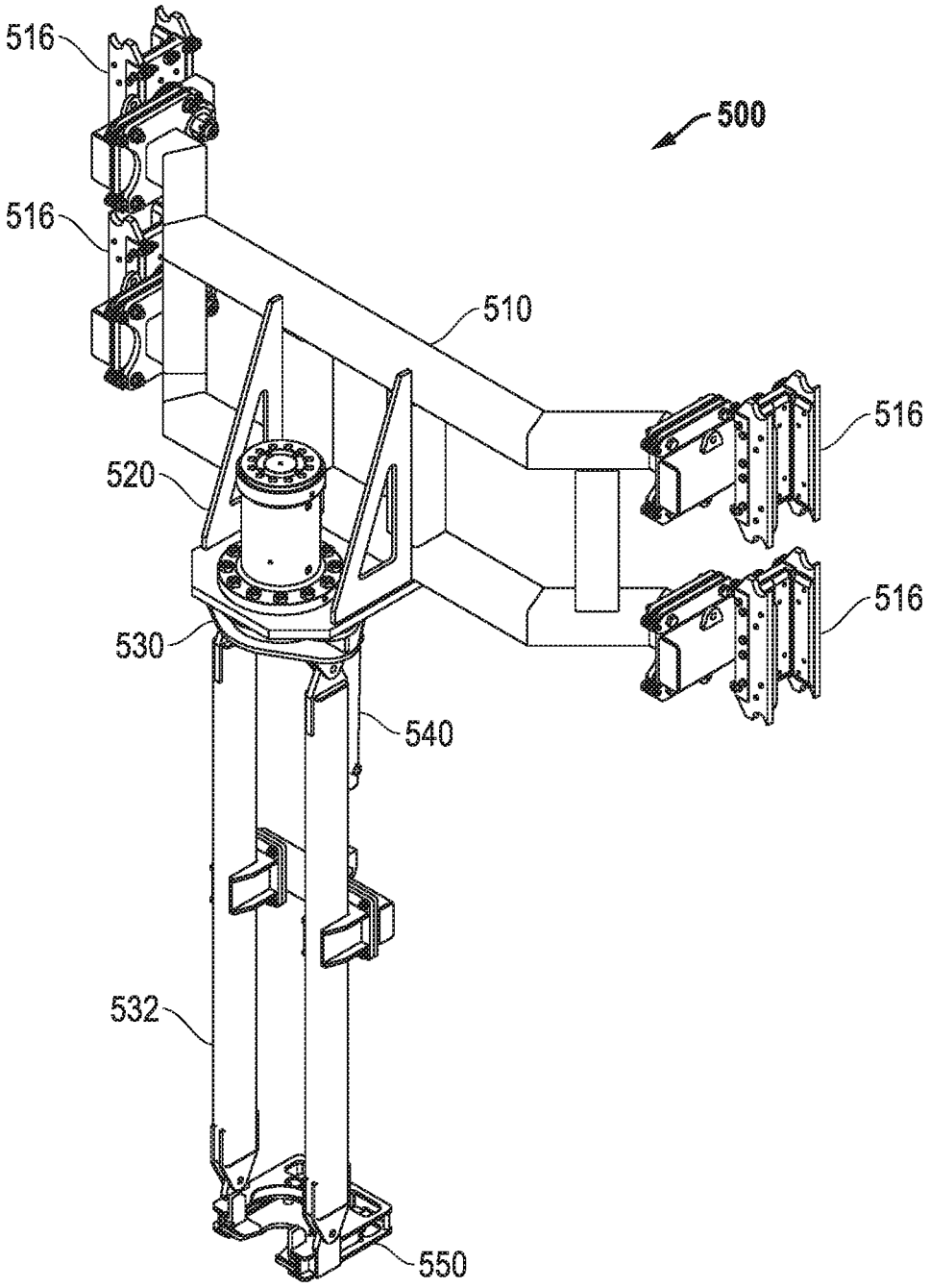
FIG. 1 is an isometric view of an embodiment of a tubular delivery arm for a drilling rig.
Figure 2:
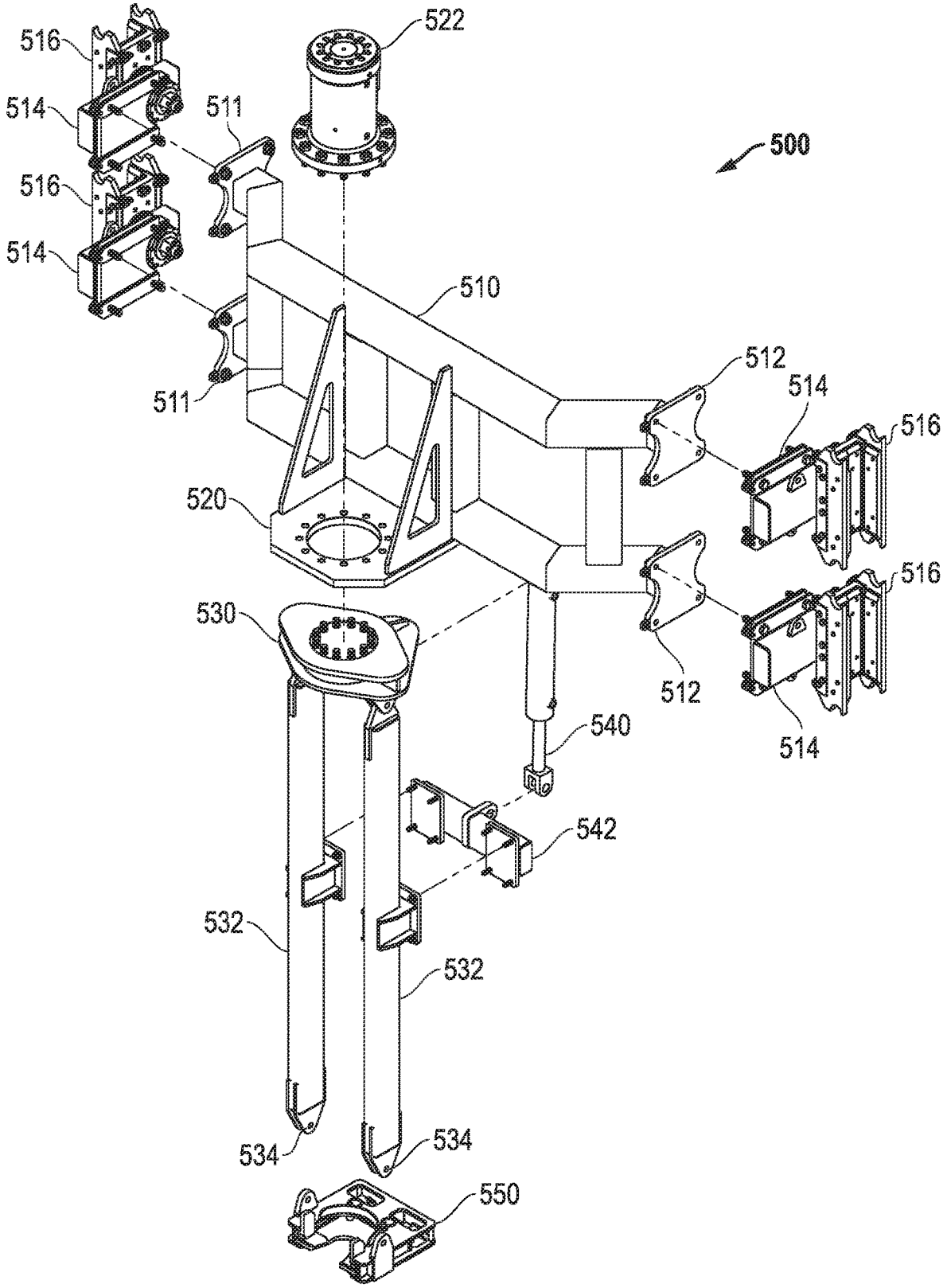
FIG. 2 is an isometric exploded view of the embodiment of the tubular delivery arm illustrated in FIG. 1.

FIG. 1 is an isometric view of an embodiment of a tubular delivery arm 500. FIG. 2 is an isometric exploded view of this embodiment of tubular delivery arm 500. As best seen in FIG. 2, tubular delivery arm 500 comprises a dolly 510. Dolly 510 is configured for vertically translatable connection to a mast 10 of a drilling rig 1 (see FIG. 4). Dolly 510 has a driller's side end 511 and an opposite off-driller's side end 512.

In the embodiment illustrated, dolly 510 is configured for sliding connection to mast 10. An adjustment pad 514 may be attached to each end 511 and 512 of dolly 510. A slide pad 516 is located on each adjustment pad 514. Slide pads 516 are configured for sliding engagement with mast 10 of drilling rig 1 or a rail set (e.g., rails 59 shown in FIG. 8) affixed to mast 10 for that purpose. Adjustment pads 514 permit precise centering and alignment of dolly 510 on mast 10. Similar slide assemblies or roller assemblies may be substituted for this purpose. Alternatively, a rack and gear arrangement may be provided.

An arm bracket 520 extends outward from dolly 510 in the V-door direction. An arm 532 (or pair of arms 532) is pivotally and rotational connected to arm bracket 520. Although the embodiments illustrated depict a pair of arms, they are connected in a manner to function as a single arm, and it will be understood that a single arm 532 could be depicted having an opening above clasp 550 for clearance of tubular stand 80. An actuator bracket 542 is connected to arm 532, or as between arms 532. In one embodiment, a tilt actuator 540 is pivotally connected between actuator bracket 542 and one of either dolly 510 or arm bracket 520.

Pivot connection 534 is located on the lower end of each arm 532 (or on a bifurcated end of arm 532). Clasp 550 is pivotally connected to the pivot connections 534 at the lower end of each arm 532. In one embodiment, pivot connections 534 are located on the center of the lower end of arms 532 and clasp 550 is likewise pivotally connected at its center.

In this embodiment, a centerline of tubular stand 80 is secured in clasp 550 and located between pivot connections 534 at the lower ends of each arm 532. In this configuration, clasp 550 is self-balancing to suspend tubular stand 80 or a tubular section (drill pipe or drill collar) 2 vertically, without additional inclination controls or adjustments.

In the embodiment illustrated, a first pair of slide pads 516 is located on the driller's side end 511 of dolly 510, and a second pair of slide pads 516 is located on the off-driller's side end 512 of dolly 510.

In one embodiment, a rotary actuator 522 is mounted to arm bracket 520 and has a drive shaft (not shown) extending through arm bracket 520. A drive plate 530 is rotatably connected to the underside of arm bracket 520 and connected to the drive shaft of rotary actuator 522. Rotary actuator 522 provides control of the rotational connection between dolly 510 and arm 532.

In this embodiment, tilt actuator 540 is pivotally connected between actuator bracket 542 and drive plate 530 to provide control of the pivotal relationship between dolly 510 and arm 532.

Figure 3:
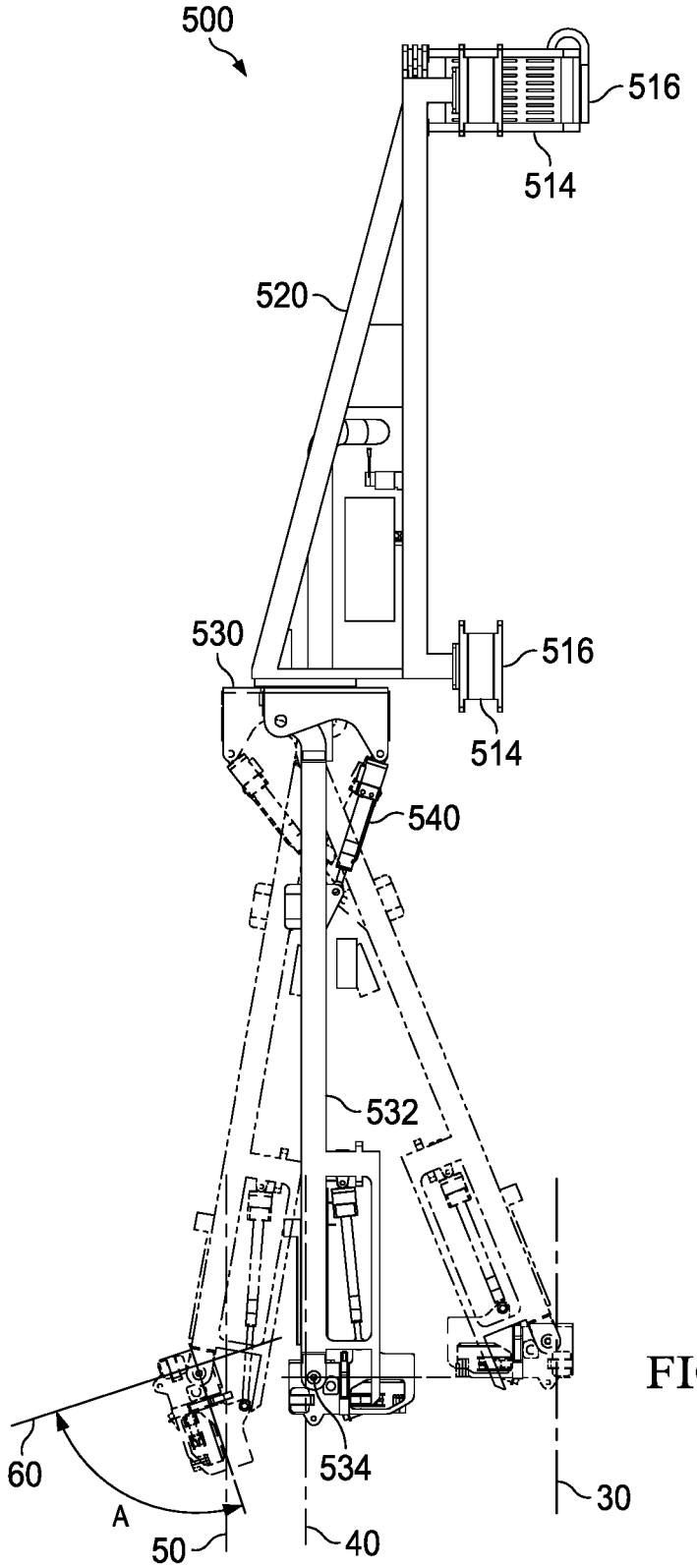
FIG. 3 is a side view of another embodiment of the tubular delivery arm illustrated, illustrating the range of the tubular delivery arm to position a tubular stand pipe relative to positions of use on a drilling rig.

FIG. 3 is a side view of the embodiment of tubular delivery arm 500 of FIG. 1 and FIG. 2, illustrating the lateral range of the motion of tubular delivery arm 500 to position a tubular stand 80 relative to positions of use on a drilling rig 1. Illustrated is the capability of tubular delivery arm 500 to retrieve and deliver a tubular stand 80 as between a well center 30, a mousehole 40, and a stand hand-off position 50. Also illustrated is the capability of tubular delivery arm 500 to move to a catwalk position 60 and incline clasp 550 for the purpose of retrieving or delivering a tubular section 2 from a catwalk 600.

Figure 4:
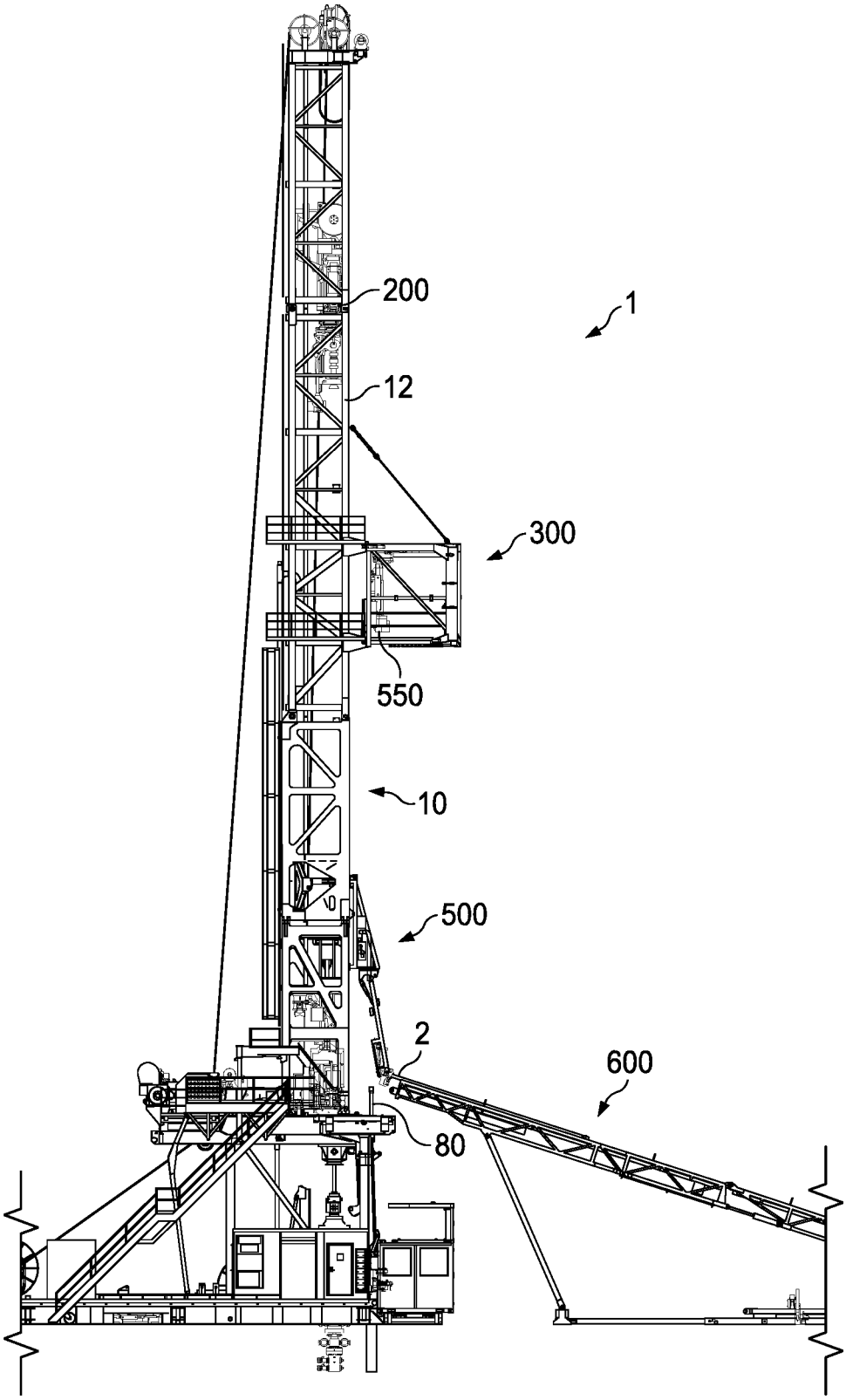
FIG. 4 is a side view of an embodiment of the tubular delivery arm connected to a drilling mast and in position to receive a section of drill pipe from the catwalk.

FIG. 4 is a side view of the embodiment of tubular delivery arm 500 shown connected to drilling mast 10 of drilling rig 1 in catwalk position 60 (see FIG. 3) to receive a tubular section 2 from catwalk 600. For this purpose, it is advantageous to have inclination control of clasp 550, as disclosed in an embodiment shown in FIGS. 11-14.

Figure 5:
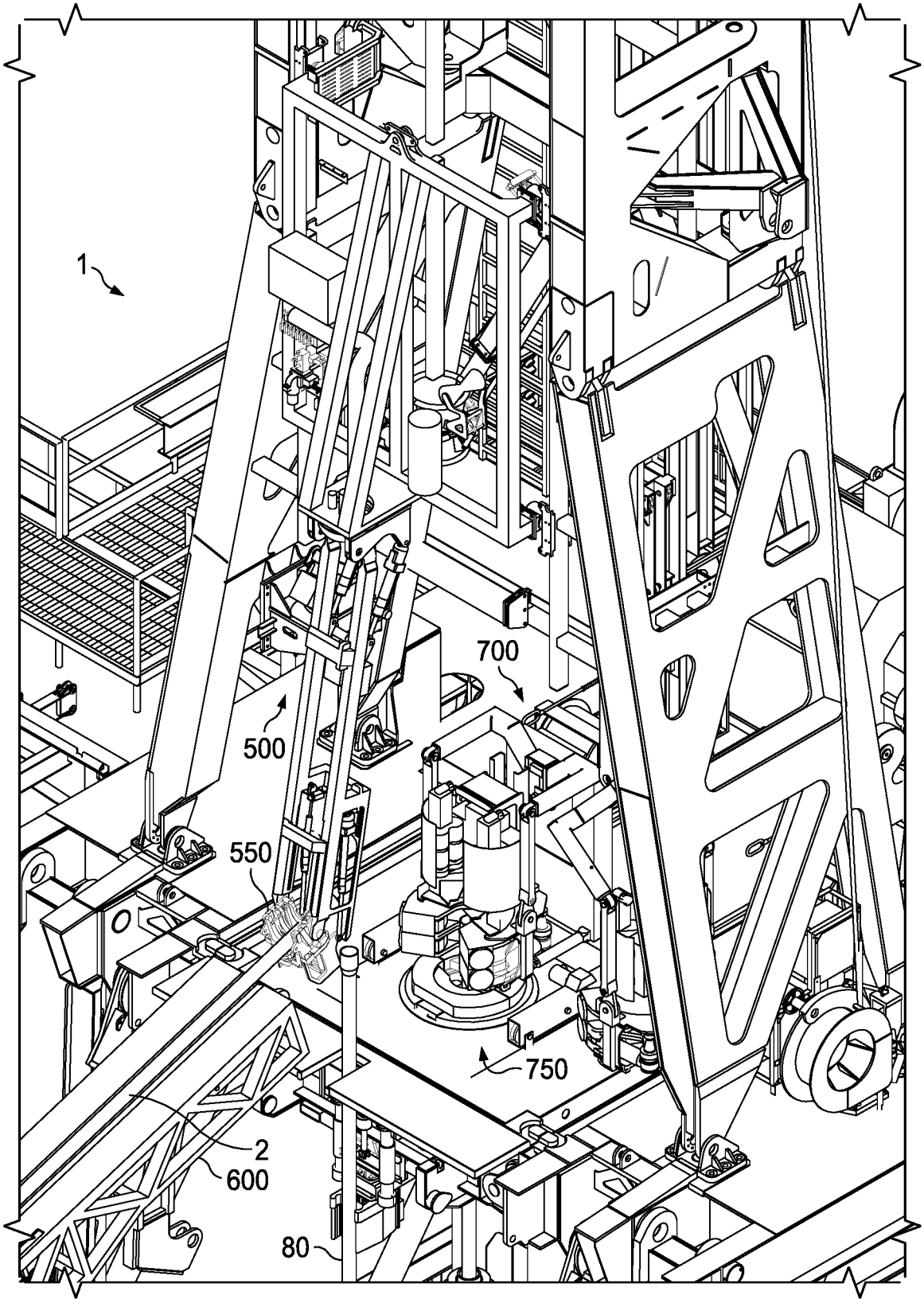
FIG. 5 is an isometric view of the embodiment of the tubular delivery arm of FIG. 4, illustrating the tubular delivery arm receiving a section of drill pipe from the catwalk.

FIG. 5 is an isometric view of the embodiment of tubular delivery arm 500 of FIG. 4, receiving a tubular section 2 (drill pipe 2) from catwalk 600. As seen in this view, tubular delivery arm 500 is articulated outwards by tilt actuator 540 to permit clasp 550 to attach to tubular section 2. From this position, tubular delivery arm 500 can be used to deliver tubular section 2 to the well center for make-up with the drill string in the well by an iron roughneck 750 shown positioned by a drill floor manipulating arm 700. Alternatively, tubular delivery arm 500 can be used to build a stand with another drill pipe 2 secured in a mousehole 40 having a mousehole center (see FIGS. 3 and 6).

Figure 6:
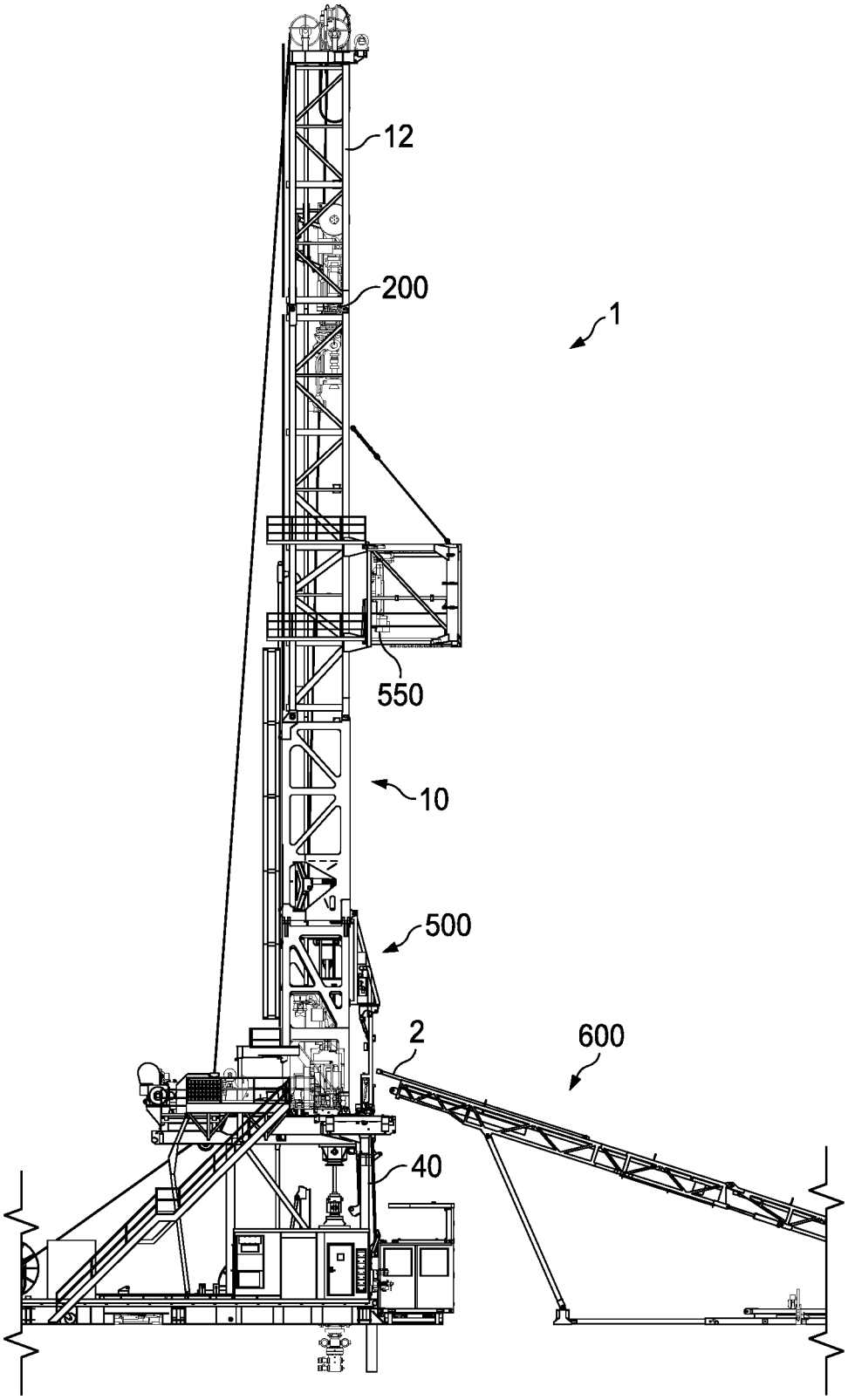
FIG. 6 is a side view of an embodiment of the tubular delivery arm connected to a drilling mast and positioned to receive a tubular stand from, or deliver a section of pipe to, the mousehole.

FIG. 6 is a side view of an embodiment of tubular delivery arm 500 connected to a drilling mast 10 in position to receive or deliver tubular stand 80 to mousehole 40.

Figure 7:
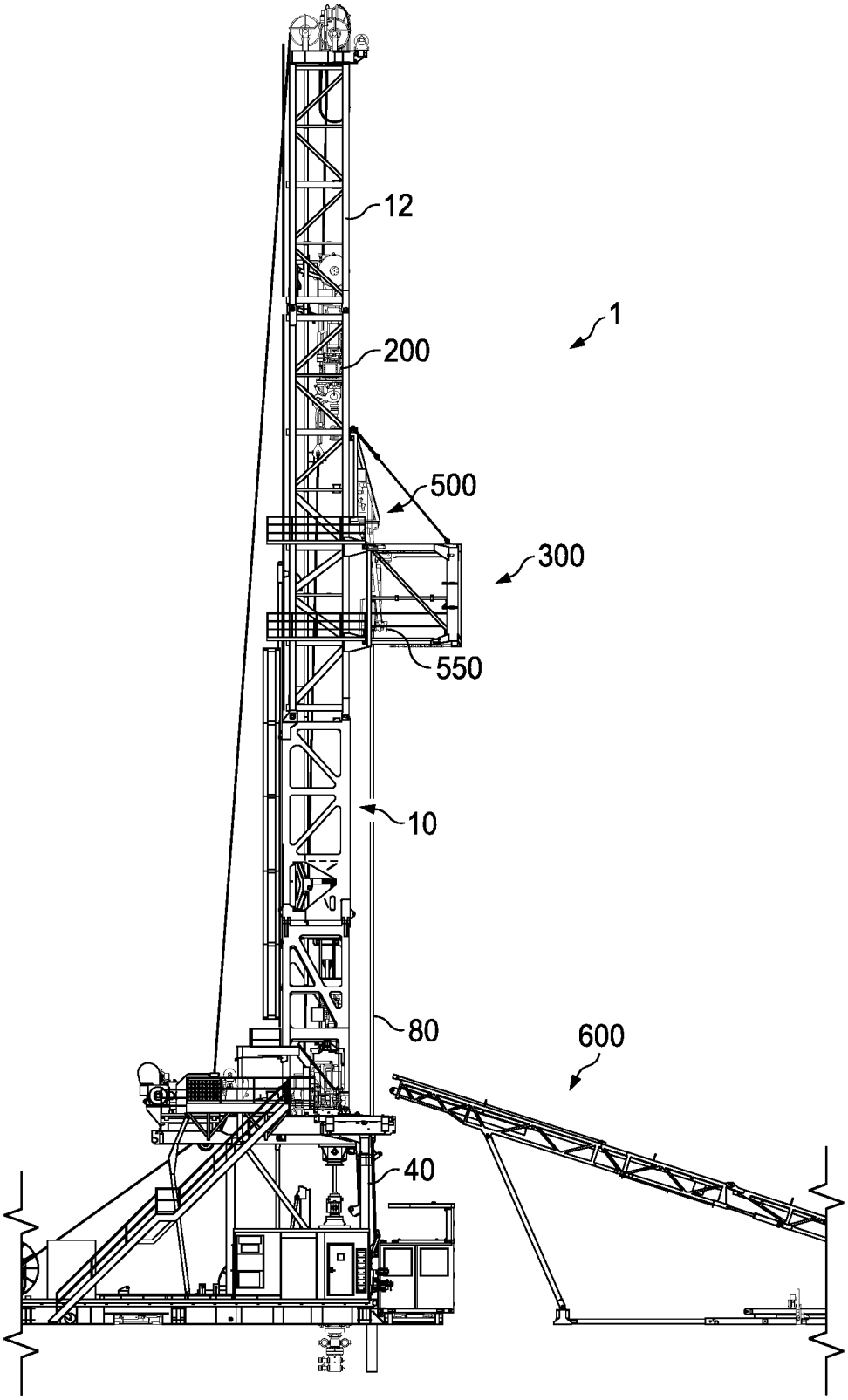
FIG. 7 is a side view of an embodiment of the tubular delivery arm connected to a drilling mast and in position to receive (or deliver) a tubular stand at the stand hand-off position at the racking module.

FIG. 7 is a side view of an embodiment of tubular delivery arm 500 connected to a drilling mast 10 and in position to receive (or deliver) tubular stand 80 from stand hand-off position 50 at racking module 300.

Figure 8:
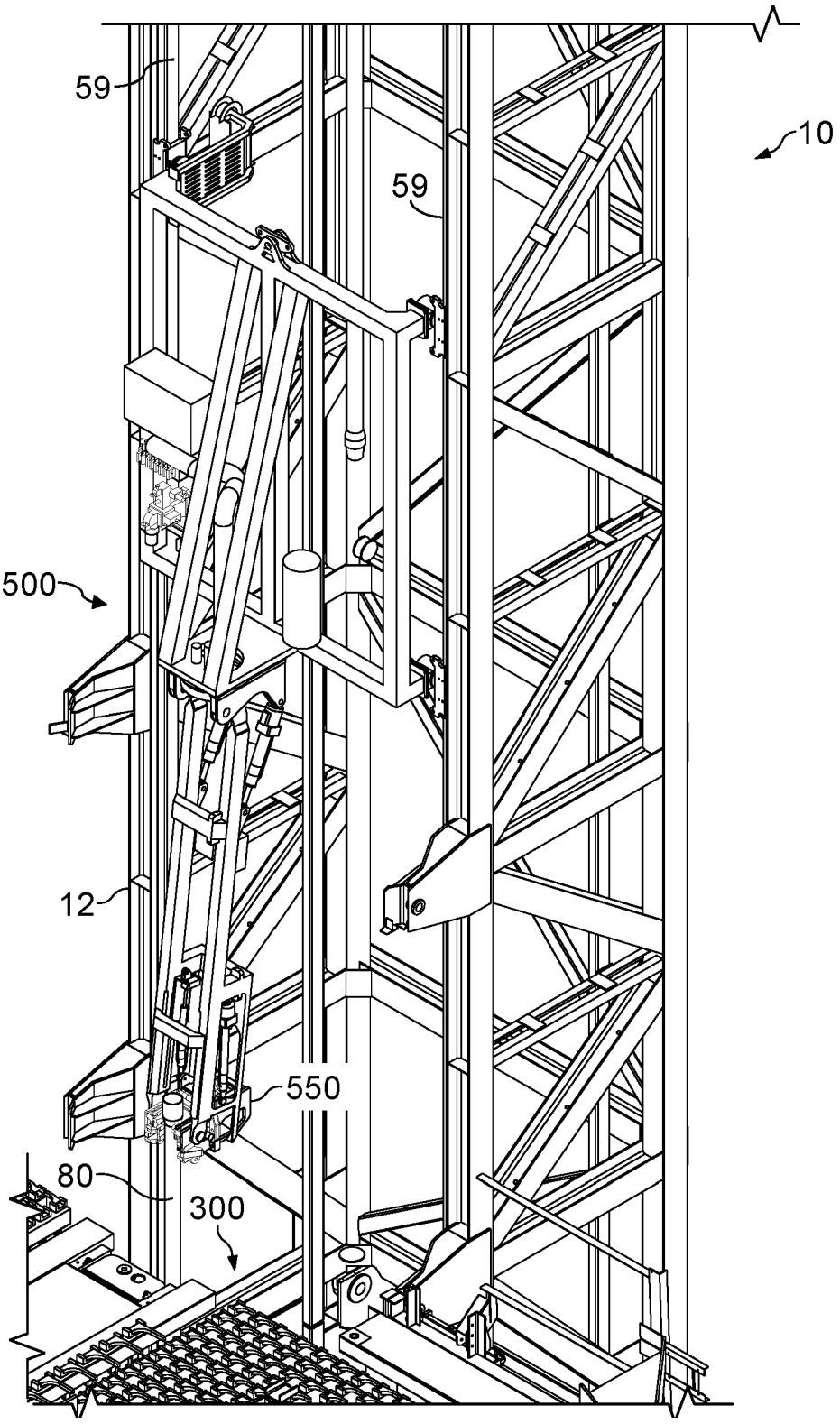
FIG. 8 is an isometric view of the embodiment of the tubular delivery arm of FIG. 7, illustrating the tubular delivery arm positioned over the stand hand-off position between the racking module and the mast, and having a tubular stand secured in the clasp.

FIG. 8 is an isometric view of the embodiment of tubular delivery arm 500 of FIG. 7, illustrating tubular delivery arm 500 articulated to stand hand-off position 50 between racking module 300 and mast 10, and having tubular stand 80 secured in clasp 550.

In one embodiment, slide pads 516 are slidably engageable with the front side (V-door side) 12 of drilling mast 10 to permit tubular delivery arm 500 to travel up and down front side 12 of mast 10. Rails 59 may be attached to mast 10 for receiving slide pads 516. Tilt actuator 540 permits clasp 550 to swing over at least well center 30 and mousehole 40.

Figure 9:
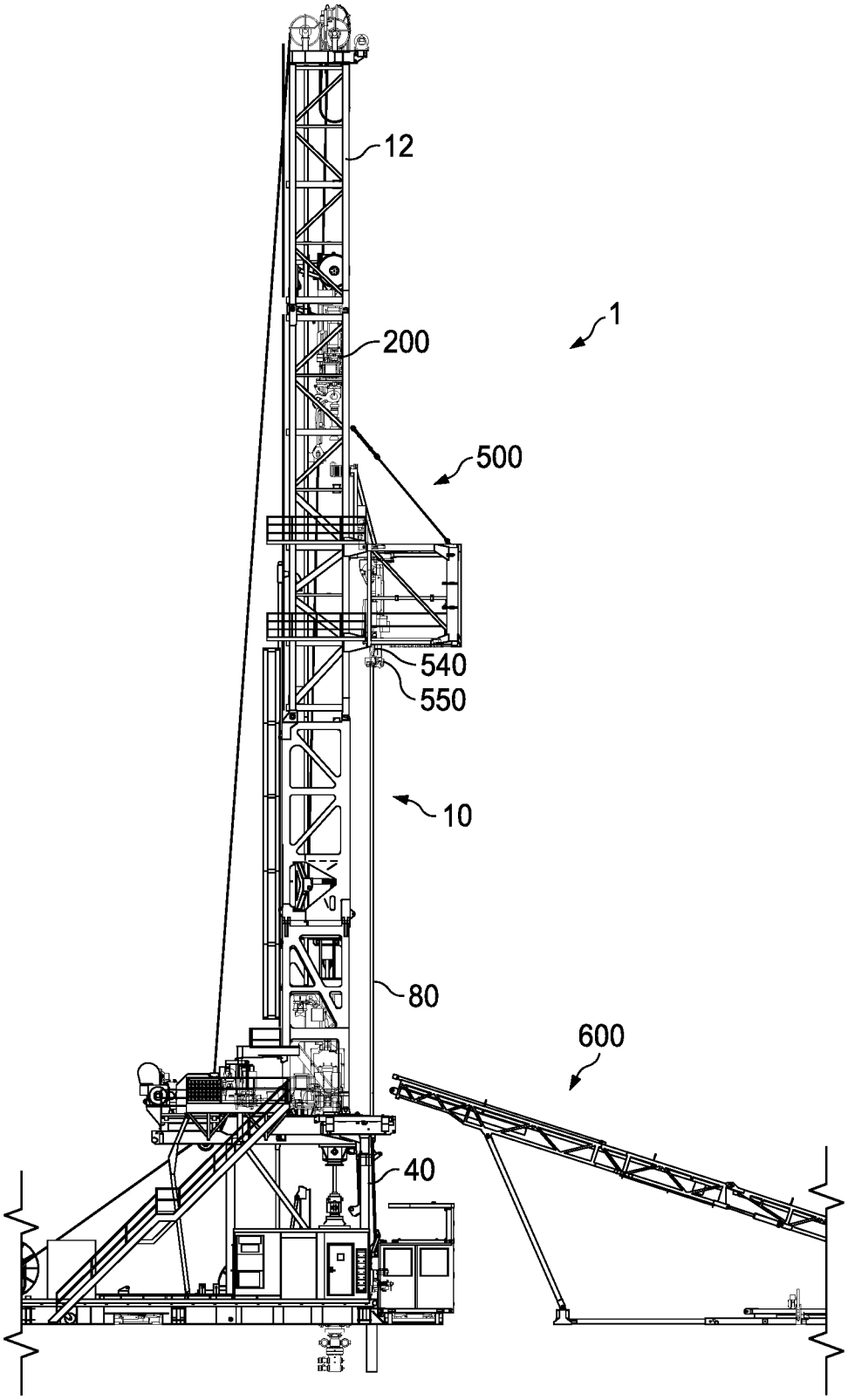
FIG. 9 is a side view of an embodiment of the tubular delivery arm connected to a drilling mast and positioned over well center to deliver a tubular stand into a stump at the well center, and to release the tubular stand when secured by the top drive.

FIG. 9 is a side view of an embodiment of tubular delivery arm 500 connected to drilling mast 10 and in position to deliver tubular stand 80 to well center 30 to stab into a stump secured at well center 30. After stabbing, tubular delivery arm 500 can hand tubular stand 80 off to top drive 200.

Figure 10:
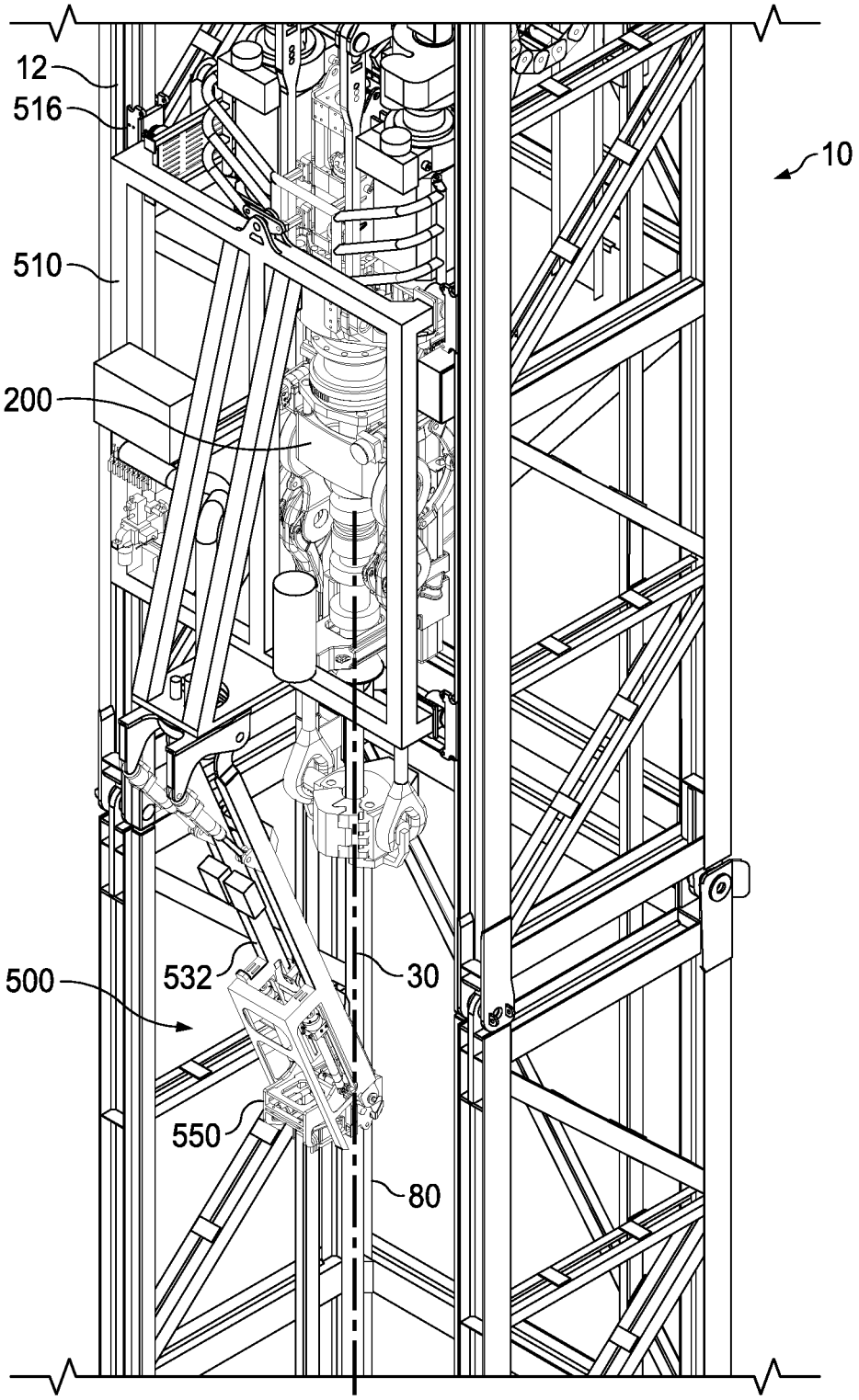
FIG. 10 is an isometric view of the embodiment of the tubular delivery arm of FIG. 9, illustrating the tubular delivery arm articulated over the well center and handing a stand of drill pipe off to the top drive.

FIG. 10 is an isometric view of the embodiment of tubular delivery arm 500 of FIG. 9, illustrating tubular delivery arm 500 being articulated over well center 30 and handing drill string connected tubular stand 80 off to top drive 200. Tubular delivery arm 500 is articulated by expansion of tilt actuator 540 (best seen in FIG. 13) which inclines arm 532 into position such that the centerline of tubular stand 80 in clasp 550 is properly over well center 30.

Figure 11:
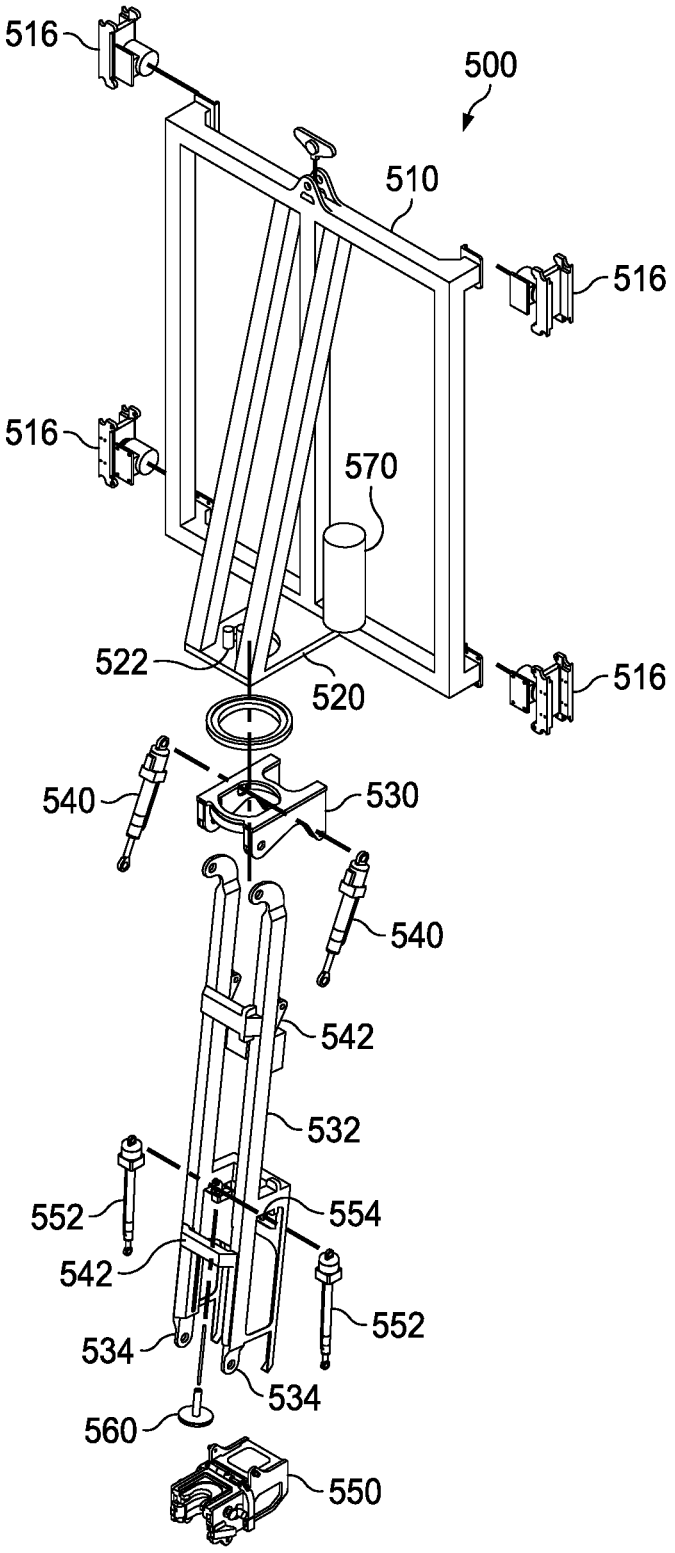
FIG. 11 is an isometric exploded view of an alternative embodiment of the tubular delivery arm.

FIG. 11 is an isometric exploded view of an alternative embodiment of tubular delivery arm 500. Tubular delivery arm 500 comprises a dolly 510. Adjustment pads 514 (not shown) may be attached to ends 511, 512 of dolly 510. A slide pad 516 is located on each adjustment pad 514. Slide pads 516 are configured for sliding engagement with mast 10 of drilling rig 1 (see FIG. 15). Translatable engagement with mast 10 is intended to reference translatable engagement with rails affixed to mast 10 for that purpose as detailed further below. Adjustment pads 514 permit precise centering and alignment of dolly 510 on mast 10. Similar alternative slide assemblies or roller assemblies may be substituted for this purpose.

An arm bracket 520 extends from dolly 510. A drive plate 530 is rotatably connected to the underside of arm bracket 520. One or more arms 532 are pivotally and rotationally connected to arm bracket 520. An actuator bracket 542 is connected to arms 532. A rotary actuator 522 is mounted to arm bracket 520 for controlled rotation of arms 532 relative to dolly 510.

A tilt actuator 540 is pivotally connected between actuator bracket 542 and drive plate 530. Extension of tilt actuator 540 provides controlled pivoting of arms 532 relative to dolly 510. A tubular clasp 550 is pivotally connected to the pivot connections 534 at the lower end of arms 532.

In this embodiment, one or more extendable incline actuators 552 are pivotally connected to arms 523 at pivot connections 554, and to opposing pivot connections 534 on clasp 550. Extension of the incline actuators 552 inclines clasp 550 and tilts any tubular stand 80 held in clasp 550. This embodiment permits tilting of heavy tubular stands 80, such as large collars.

In another embodiment, a grease dispenser 560 is extendably connected to a lower end of arm 532 and extendable to position grease dispenser 560 at least partially inside of a box connection of tubular stand 80 secured by clasp 550. A grease supply line is connected between grease dispenser 560 and a grease reservoir 570 (see FIG. 12). In this position, grease dispenser 560 may be actuated to deliver grease, such as by pressurized delivery to the interior of the pin connection by either or both of spray nozzles or contact wipe application.

Figure 12:
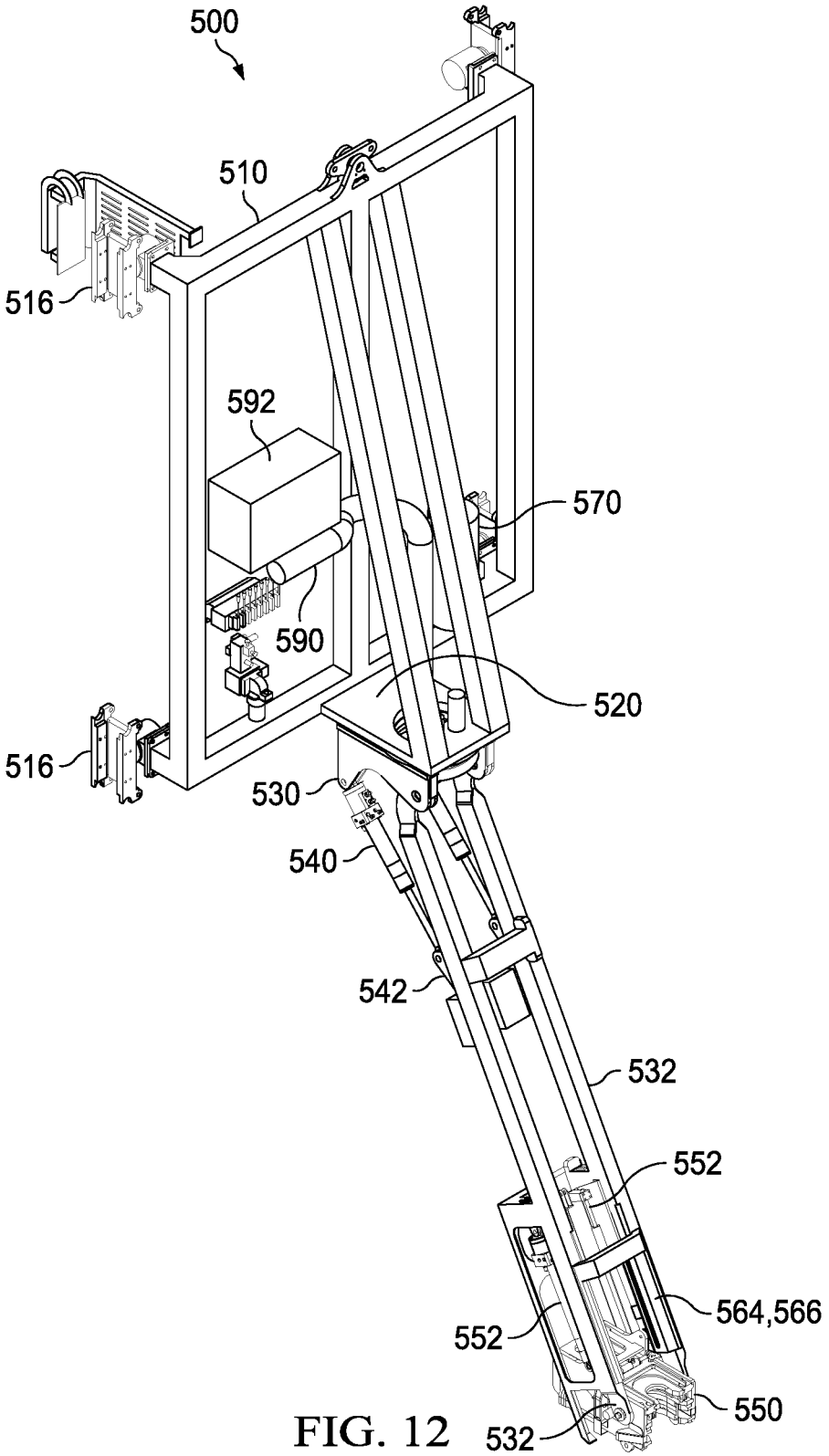
FIG. 12 a fully assembled isometric view of the alternative embodiment of the tubular delivery arm illustrated in FIG. 11.

In another embodiment illustrated in FIG. 12, a guide 564 is attached to arm 532 proximate to clasp 550. A grease dispenser 560 is connected to guide 564. An actuator 566 extends grease dispenser 560 to position it at least partially inside of a box connection of tubular stand 80 secured by clasp 550. In this position, grease dispenser 560 delivers grease to the interior of the pin connection by spray or contact application. A grease supply line (not shown) connects grease dispenser 560 to a grease reservoir 570 that may be mounted on dolly 510 or otherwise on transfer delivery arm 500. Alternatively, grease reservoir 570 may be located at the drill floor or other convenient location and the grease supplied along the grease supply line under pressure.

The automatic greasing (doping) procedure improves safety by eliminating the manual application at the elevated position of tubular stand 80. The procedure adjusts to the height of the tubular stand 80 length automatically and is centered automatically by its connectivity to tubular delivery arm 500. The procedure may improve the efficiency of the distribution of the grease as well as cleanliness, thereby further improving safety by reducing splatter, spills, and over-application.

FIG. 12 is a fully assembled isometric view of the alternative embodiment of the tubular delivery arm 500 illustrated in FIG. 11, illustrating arms 532 rotated and tilted to position clasp 550 over stand hand-off position 50 (see also FIG. 3).

Figure 13:
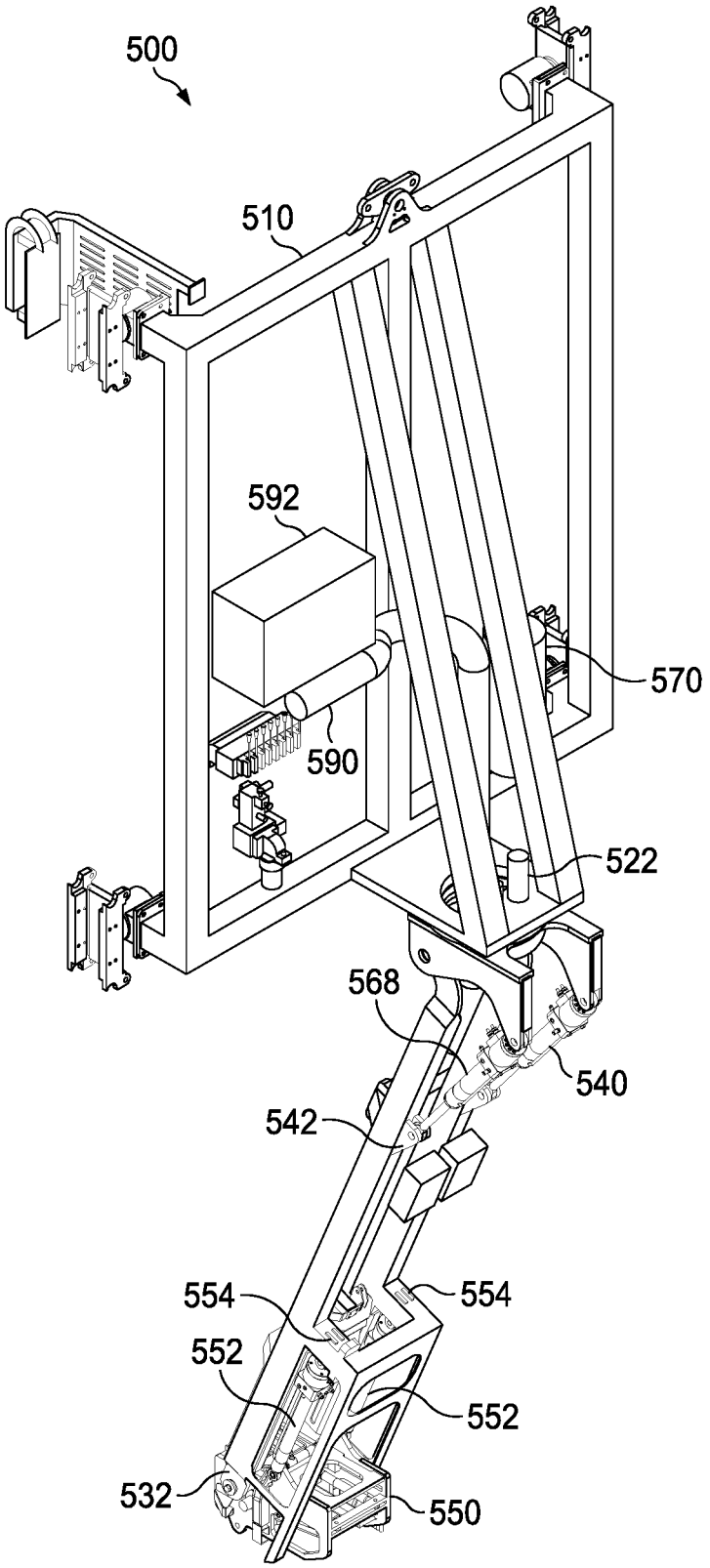
FIG. 13 is an isometric view of the embodiment of the tubular delivery arm of FIGS. 11 and 12, illustrating the arms rotated and in position over the well center.

FIG. 13 is an isometric view of the embodiment of tubular delivery arm 500 of FIGS. 11 and 12, illustrating arms 532 rotated and tilted to position clasp 550 over well center 30.

Figure 14:
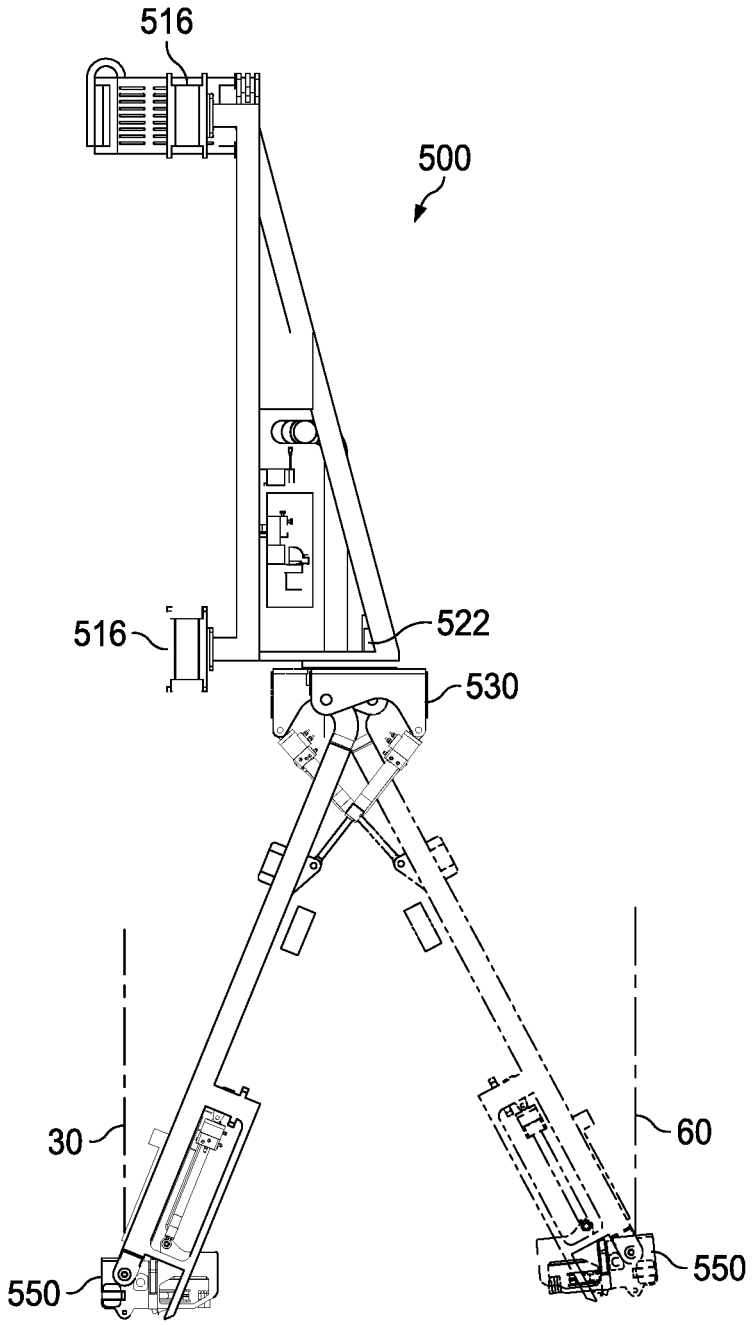
FIG. 14 is a side view of the embodiment of the tubular delivery arm illustrated in FIGS. 11-13, illustrating the range of the tubular delivery arm to position a tubular stand.

FIG. 14 is a side view of the embodiment of tubular delivery arm 500 illustrated in FIGS. 11-13, illustrating the range of tubular delivery arm 500 to position a tubular stand 80 (not shown) with clasp 550.

Figure 15:
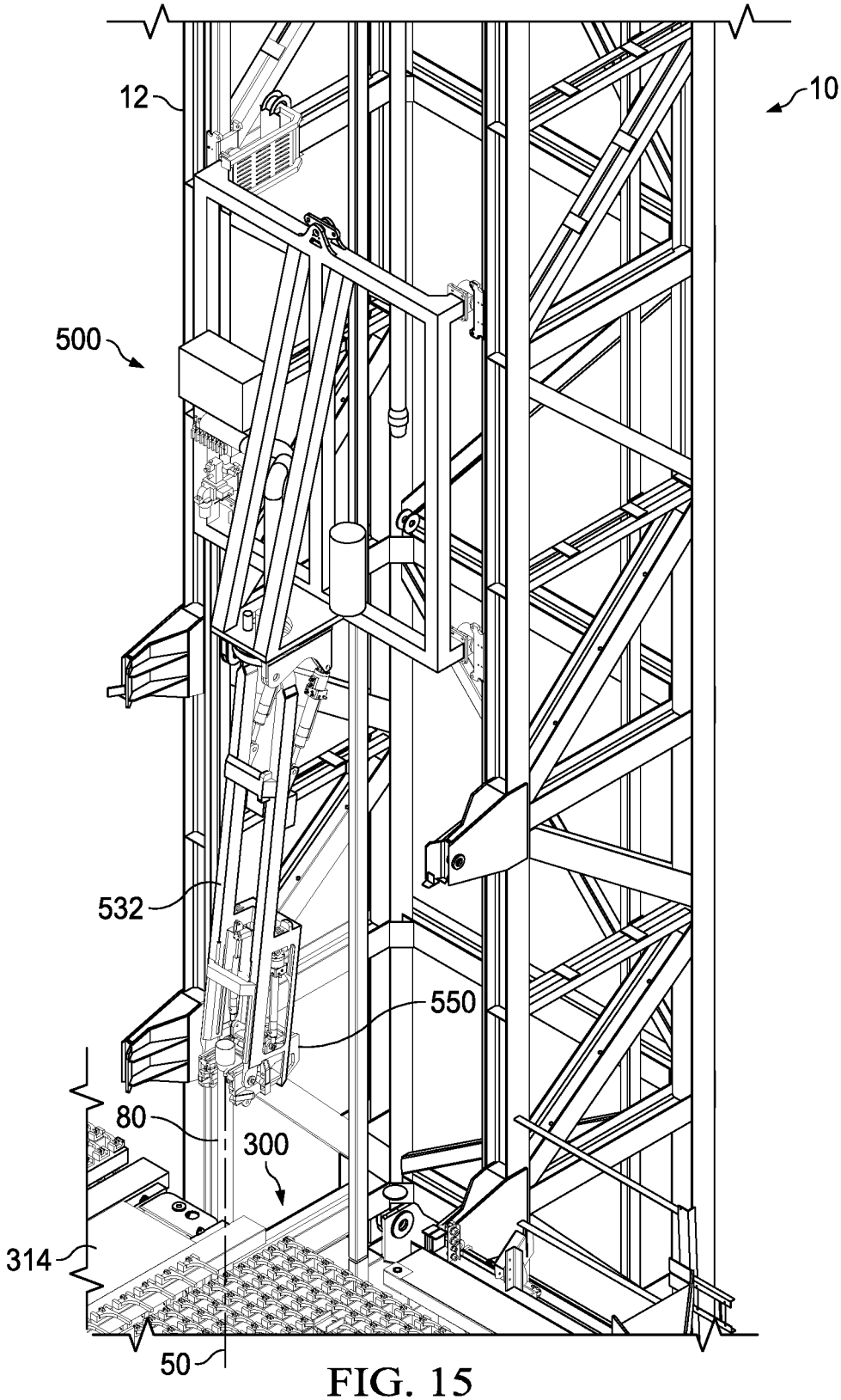
FIG. 15 is an isometric view of the embodiment of the tubular delivery arm of FIGS. 11-14, illustrating the tubular delivery arm articulated to the stand hand-off position between the racking module and the mast, and having a tubular stand secured in the clasp.

FIG. 15 is an isometric view of the embodiment of tubular delivery arm 500 of FIGS. 11-14, illustrating tubular delivery arm 500 articulated to stand hand-off position 50 between racking module 300 and mast 10, and having tubular stand 80 secured in clasp 550.

Figure 16:
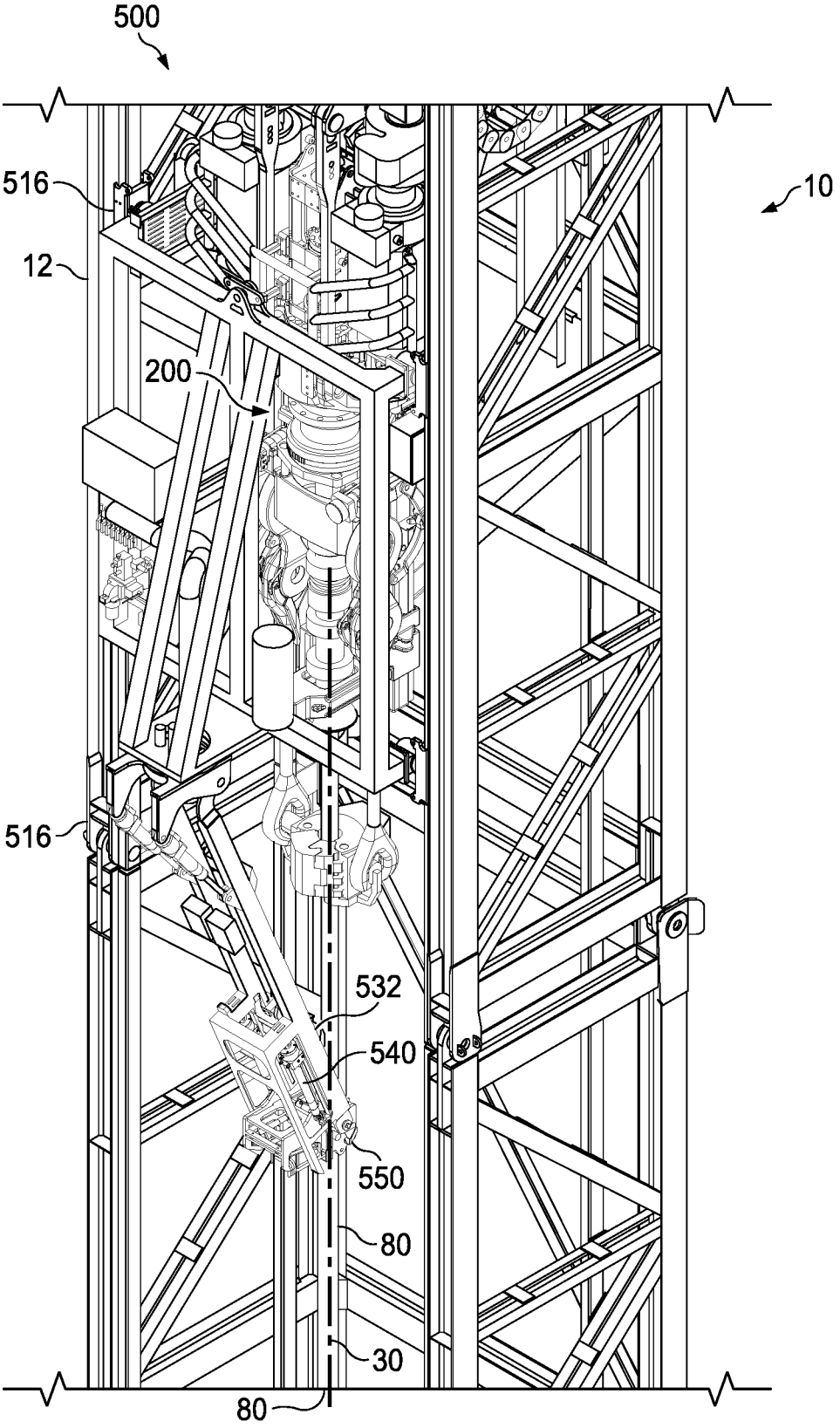
FIG. 16 is an isometric view of the embodiment of the tubular delivery arm of FIG. 15, illustrating the tubular delivery arm articulated over the well center and handing or receiving a tubular stand to the top drive.

FIG. 16 is an isometric view of the embodiment of tubular delivery arm 500 of FIG. 15, illustrating tubular delivery arm 500 articulated to well center 30 under mast 10, and having tubular stand 80 secured in clasp 550.

Figure 17:
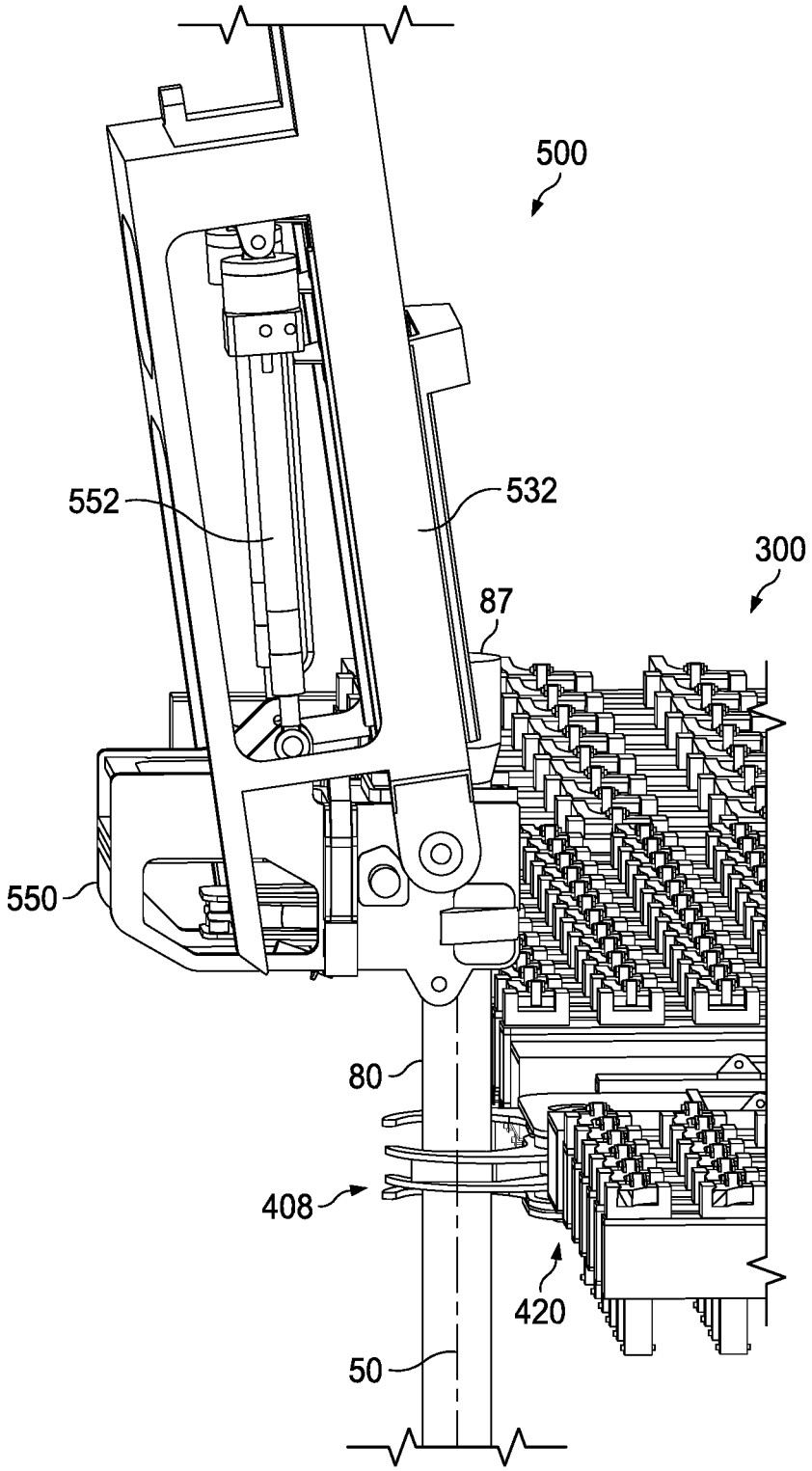
FIG. 17 is an isometric view of the embodiment of the tubular delivery arm of FIG. 16, illustrating the tubular delivery arm articulated to reach a tubular stand held by an upper stand constraint component at the stand hand-off position.

FIG. 17 is an isometric view of the embodiment of the tubular delivery arm of FIG. 16, illustrating tubular delivery arm 500 connected to tubular stand 80 at stand hand-off position 50. Tubular stand 80 is shown secured in the stand hand-off position by clasp 408 of upper stand constraint 420 beneath racking module 300. In this position, tubular delivery arm 500 may activate grease dispenser 560 to apply an appropriate amount of grease inside the box end of tubular stand 80.

Figure 18:
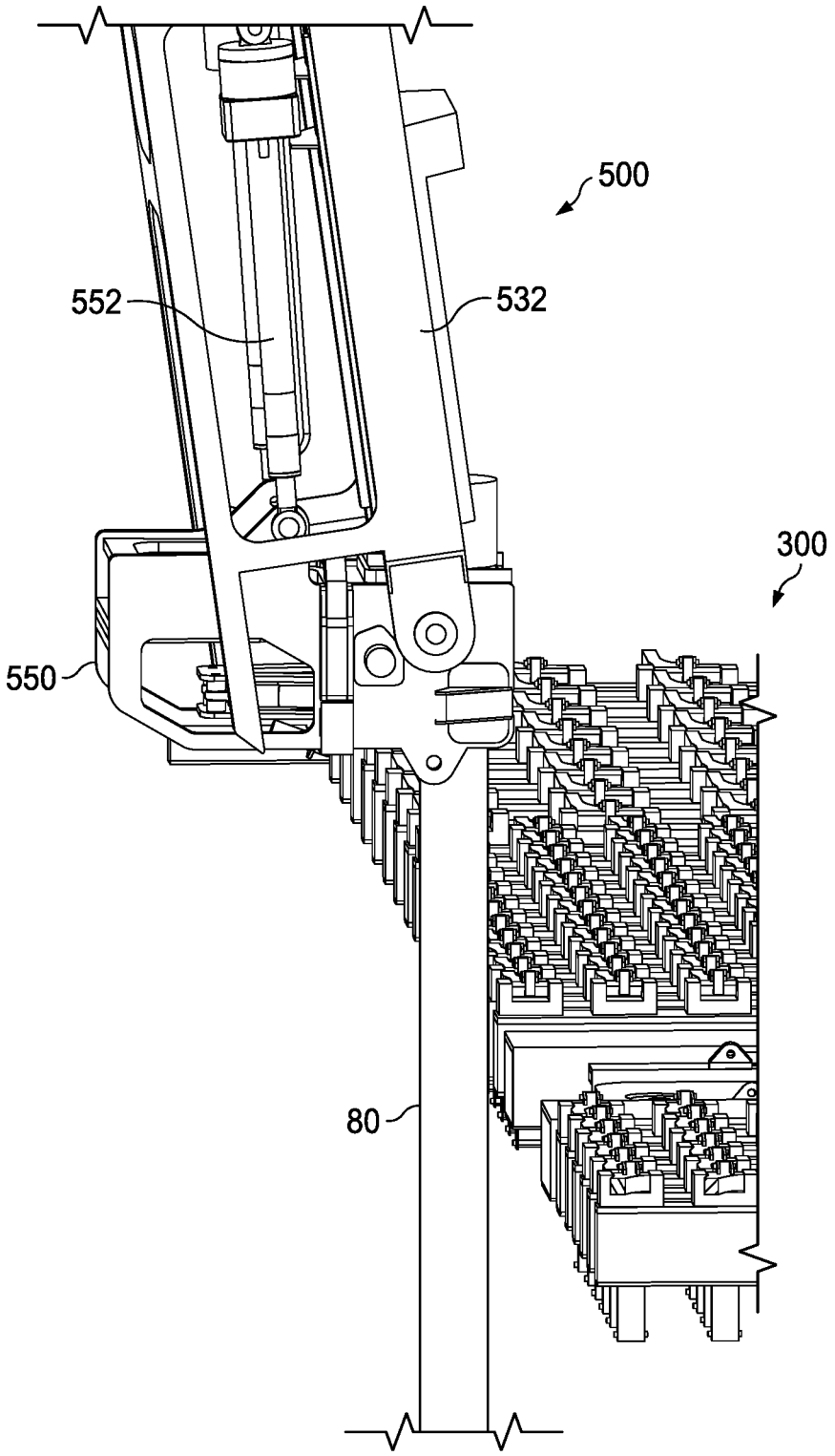
FIG. 18 is an isometric view of the embodiment of the tubular delivery arm of FIG. 17, illustrating the upper stand constraint having released the tubular stand and the tubular delivery arm hoisting the tubular stand as the grease dispenser is lowered to spray grease into the box end of the tubular stand being lifted.

FIG. 18 is an isometric view of the embodiment of tubular delivery arm 500 of FIG. 17, illustrating tubular delivery arm 500 hoisting tubular stand 80 released by upper stand constraint 420 away from stand hand-off position 50 adjacent to racking module 300.

In this manner, tubular delivery arm 500 is delivering and centering tubular stands 80 for top drive 200. This design allows independent and simultaneous movement of tubular delivery arm 500 and top drive 200. This combined capability provides accelerated trip speeds. The limited capacity of tubular delivery arm 500 to lift tubular stands 80 of drill pipe drill collars allows the weight of tubular delivery arm 500 and mast 10 to be minimized. Tubular delivery arm 500 can be raised and lowered along the front 12 of mast 10 with an electronic crown winch. Alternatively, tubular delivery arm 500 can be raised and lowered along mast 10 by means of a rack and pinion arrangement, with drive motors.

If used herein, the term "substantially" is intended for construction as meaning "more so than not."

Having thus described the various embodiments, it is noted that the embodiments disclosed are illustrative rather than limiting in nature and that a wide range of variations, modifications, changes, and substitutions are contemplated in the foregoing disclosure and, in some instances, some features may be employed without a corresponding use of the other features. Many such variations and modifications may be considered desirable by those skilled in the art based upon a review of the foregoing description of embodiments. Accordingly, it is appropriate that the appended claims be construed broadly and in a manner consistent with the scope of the disclosure.

The invention claimed is:

1. A tubular delivery arm (500) for a drilling rig (1), comprising:

a dolly (510) vertically translatably connected to a mast (10) of the drilling rig (1);

an arm (532) rotatably and pivotally connected to the dolly (510) at its upper end;

a tubular clasp (550) pivotally connected to the arm (532) at its lower end, wherein the tubular delivery arm (500) is translatable along the mast (10) in non-conflicting passage of a top drive (200) connected to the same mast (10);

a grease dispenser extendably connected to a lower end of the arm; and a grease supply line connected between the grease dispenser and a grease reservoir, wherein extension of the grease dispenser positions the grease dispenser at least partially inside of a box connection of a tubular stand secured by the tubular clasp, and wherein the grease dispenser delivers grease to an interior of the box connection.

2. The tubular delivery arm of claim 1, further comprising:

the tubular clasp of the tubular delivery arm movable between a well center position and a mousehole position forward of the well center position.

3. The tubular delivery arm of claim 1, further comprising:

the tubular clasp of the tubular delivery arm movable between a well center position and a stand hand-off position forward of the well center position.

4. The tubular delivery arm of claim 1, further comprising:

the tubular clasp of the tubular delivery arm movable between a well center position and a catwalk position forward of the first position.

5. The tubular delivery arm of claim 1, further comprising:

the tubular delivery arm having sufficient capacity to hoist a stand of drilling tubulars.

6. The tubular delivery arm of claim 1, further comprising:

the tubular delivery arm positionable on a tubular stand for coincident attachment to the tubular stand by the top drive, at the well center position.

7. The tubular delivery arm of claim 1, further comprising:

an arm bracket connected to the dolly;

a drive plate rotatably connected to the arm bracket;

a rotate actuator connected to the arm bracket and drive plate;

the arm pivotally connected to the drive plate; and, the rotate actuator providing the rotatable connection between the arm and the dolly.

8. The tubular delivery arm of claim 7, further comprising:

an actuator bracket connected between the arms;

a tilt actuator pivotally connected between the drive plate and the arm bracket; and, the tilt actuator providing the pivotal connection between the arm and the dolly.

9. The tubular delivery arm of claim 7, further comprising:

an incline actuator pivotally connected between the arm and the clasp; and, the incline actuator providing the pivotal connection between the clasp and the arm.

10. The tubular delivery arm of claim 7, further comprising:

an adjustment pad attached to each slide pad.

11. The tubular delivery arm of claim 1, further comprising:

the dolly translating a vertical path on the V-door side of the top drive.

12. The tubular delivery arm of claim 1, further comprising:

the tubular delivery arm translates the mast independently of a top drive on the same mast.

13. The tubular delivery arm of claim 1, further comprising:

a first rail connected to the driller's side of the mast;

a second rail connected to the off-driller's side of the mast;

slide pads connected to the dolly and engaged with the first rail; and, slide pads connected to the dolly and engaged with the second rail.

14. The tubular delivery arm of claim 1, further comprising:

a centerline of a tubular stand secured in the clasp is located between the clasp pivot connections at the lower ends of each arm.

15. The tubular delivery arm of claim 1, wherein:

the grease reservoir is mounted on the dolly; and, the grease reservoir is pressurized for delivery of grease through the supply line and grease dispenser.

16. A tubular delivery arm (500) for a drilling rig (1), comprising:

a dolly (510) vertically translatably connected to a mast (10) of the drilling rig (1);

an arm (532) rotatably and pivotally connected to the dolly (510) at its upper end;

a tubular clasp (550) pivotally connected to the arm (532) at its lower end, wherein the tubular delivery arm (500) is translatable along the mast (10) in non-conflicting passage of a top drive (200) connected to the same mast (10);

an articulated rail attached to the arm proximate the tubular clasp; and a grease dispenser translatably mounted to the rail;

wherein translation of the grease dispenser along the articulated rail positions the grease dispenser to deliver grease to a box connection of a tubular stand secured by the tubular clasp.

* * * * *